US008347827B2

(12) United States Patent
Travaly et al.

(10) Patent No.: US 8,347,827 B2
(45) Date of Patent: Jan. 8, 2013

(54) DESUPERHEATER FOR A STEAM TURBINE GENERATOR

(75) Inventors: Andrew Travaly, Ballston Spa, NY (US); Jonathan Marmillo, Exton, PA (US)

(73) Assignee: General Electric Company, Schenectady, NY (US)

( * ) Notice: Subject to any disclaimer, the term of this patent is extended or adjusted under 35 U.S.C. 154(b) by 937 days.

(21) Appl. No.: 12/424,570

(22) Filed: Apr. 16, 2009

(65) Prior Publication Data

US 2010/0263607 A1 Oct. 21, 2010

(51) Int. Cl.
*F22G 1/02* (2006.01)

(52) U.S. Cl. ..... 122/467; 122/466

(58) Field of Classification Search ..... 122/460, 122/466, 483, 479.7, 467; 137/110, 599.14; 60/653, 654, 666, 667, 678; 238/34.5
See application file for complete search history.

(56) References Cited

U.S. PATENT DOCUMENTS

| | | | | |
|---|---|---|---|---|
| 2,855,756 | A * | 10/1958 | Hayden et al. | 60/670 |
| 2,991,620 | A * | 7/1961 | Nekolny | 60/667 |
| 3,850,148 | A * | 11/1974 | Laubli | 122/479.7 |
| 4,208,882 | A * | 6/1980 | Lopes et al. | 60/653 |
| 4,899,545 | A | 2/1990 | Kalina | |
| 5,101,772 | A * | 4/1992 | Bruhn | 122/7 B |
| 6,062,017 | A * | 5/2000 | Liebig | 60/39.182 |
| 6,155,052 | A | 12/2000 | Hansen et al. | |
| 6,457,313 | B1 * | 10/2002 | Fujii | 60/653 |
| 6,964,168 | B1 | 11/2005 | Pierson et al. | |
| 2007/0245731 | A1 | 10/2007 | Pierson et al. | |
| 2007/0245733 | A1 | 10/2007 | Pierson et al. | |

FOREIGN PATENT DOCUMENTS

DE 821495 C 11/1951

OTHER PUBLICATIONS

Search Report from corresponding EP Application No. 10159926.4-2321 dated May 18, 2011.

* cited by examiner

*Primary Examiner* — John K Fristoe, Jr.
*Assistant Examiner* — Umashankar Venkatesan
(74) *Attorney, Agent, or Firm* — Nixon & Vanderhye P.C.

(57) ABSTRACT

A system for generating steam for a turbine of an electric generator includes a superheater that receives steam from a boiler and that superheats the steam. All or a portion of the superheated steam from the superheater is then passed through a heat exchanger to transfer some of the heat energy in the superheated steam to a flow of water. This reduces a temperature of the superheated steam to a temperature that is suitable for the turbine. The water heated in the heat exchanger can be condensed water that has already passed through the turbine, and the water heated in the heat exchanger can be routed to the boiler, where it is re-cycled back into steam.

10 Claims, 4 Drawing Sheets

DESUPERHEATER FOR A STEAM TURBINE GENERATOR

BACKGROUND OF THE INVENTION

The invention relates to steam turbine generators, and more specifically to the systems used to create superheated steam for a steam turbine generator.

In a typical steam generation system for a steam turbine generator, water is first supplied to a water heater, and the heated water is then supplied to a boiler. The boiler boils the water to generate steam. The steam is provided to a superheater, which then superheats the steam. The superheated steam is passed on to the steam turbine.

The temperature of the boiler is regulated by the fact that water is always present in the boiler. So long as water is present, the boiler never overheats.

However, the superheater controls its internal temperature, in part, by outputting the superheated steam. In other words, if one attempts to limit the output flow rate of the superheated steam from the superheater, the superheater can become overheated.

One can attempt to control the temperature of the superheater by controlling the amount of combustible materials or the amount of electricity provided to the superheater. However, the superheater must also be allowed to output superheated steam at whatever rate is necessary to control the temperature of the superheater on a moment-to-moment basis. As a result, the superheated steam generated by the superheater is often output at a temperature which is greater than the temperature which is optimal for the steam turbine. In some instances, the superheated steam can be at a temperature well above what the steam turbine can withstand.

In recognition of these facts, a typical steam generation system will include attemporators to cool the superheated steam output by the superheater before it reaches the turbine. In a typical attemporator, water is simply sprayed into the superheated steam to cool the superheated steam. While this is effective at reducing the temperature of the superheated steam to a temperature which is optimal for the steam turbine, the use of water in the attemporator to cool the superheated steam basically represents wasted heat. In other words, the use of an attemporator results in an inefficiency or energy loss within the system.

BRIEF DESCRIPTION OF THE INVENTION

In one aspect, the invention can be embodied in a system for generating superheated steam for a turbine that includes a superheater that receives steam from a boiler and that generates superheated steam. The system also includes a heat exchanger that receives at least a portion of the superheated steam generated by the superheater and a supply of water. The heat exchanger transfers heat from the superheated steam to the water such that a temperature of the superheated steam is lowered and a temperature of the water is raised.

In another aspect, the invention may be embodied in a system for generating superheated steam for a turbine that includes a superheater that receives steam from a boiler and that generates superheated steam. The system also includes a first heat exchanger that is also coupled to the superheater such that it can receive at least a portion of the superheated steam generated by the superheater and that is coupled to a water supply. The first heat exchanger transfers heat from the superheated steam to the water such that a temperature of the superheated steam is lowered and a temperature of the water is raised. The system further includes a second heat exchanger that is coupled to the superheater such that it can receive at least a portion of the superheated steam generated by the superheater and that is also coupled to the first heat exchanger such that it can receive water that has passed through the first heat exchanger. The second heat exchanger transfers heat from the superheated steam to the water received from the first heat exchanger such that a temperature of the superheated steam is lowered and a temperature of the water is raised. The system also includes a collection manifold that receives and mixes superheated steam after it has passed through the first and second heat exchangers to create a mixture of the superheated steam.

In another aspect, the invention can be embodied in a method of generating superheated steam for a turbine that includes the steps of generating superheated steam in a superheater, and routing a portion of the superheated steam through at least one heat exchanger to transfer heat from the superheated steam to a stream of water. This raises the temperature of the water and lowers the temperature of the portion of the superheated steam. The method also includes providing the superheated steam to the turbine after it has passed through the at least one heat exchanger.

DETAILED DESCRIPTION OF PREFERRED EMBODIMENTS

Figure 1:
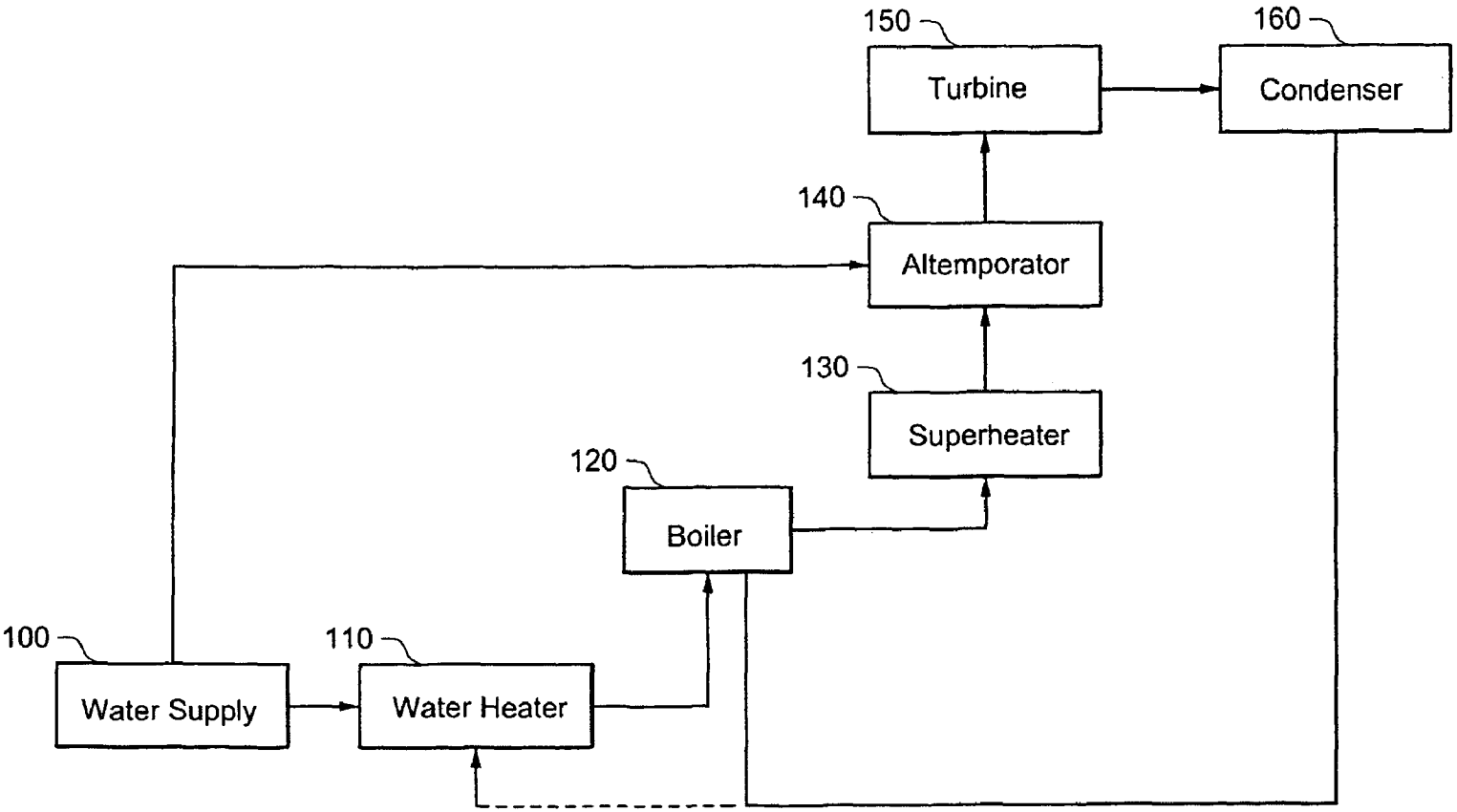
FIGURE 1 RELATED ART
FIG. 1 is a diagram of a related art steam generation and turbine system.

FIG. 1 illustrates a related art steam generator and turbine system. In the related art system, a water supply 100 supplies water to a water heater 110. The water heater 110 heats the water and provides it to a boiler 120. The boiler boils the water and generates steam, which is sent to a superheater 130. As explained above, because the superheater needs to output superheated steam at whatever rate and temperature that is necessary to control its own internal temperature, the superheater 130 often outputs superheated steam at a temperature which is higher than desired for the turbine.

Accordingly, in the related art system the steam generated in the superheater 130 passes through an attemporator 140 on its way to the turbine 150. If the temperature of the superheated steam exiting the superheater 130 is too high, the attemporator 140 sprays water into the steam to reduce the temperature of the superheated steam. The water sprayed into the superheated steam is itself vaporized, and the phase change that occurs reduces the temperature of the superheated steam. The attemporator 140 can use water from the water supply 100, or from some other point in the system.

Once the attemporator 140 has cooled the temperature of the superheated steam down to an acceptable level, the superheated steam is provided to the turbine 150. The turbine 150 drives a generator that produces electricity.

The steam used to drive the turbine 150 exits the turbine as either lower temperature steam, or water, or a mixture of the two, with the output being routed to a condenser 160. The condenser 160 then converts any remaining steam to water, and that water is returned to the boiler 120. As illustrated by the broken line in FIG. 1, in some instances, the water may be returned to the water heater 110 where it is heated before the water is provided back to the boiler 120.

Figure 2:
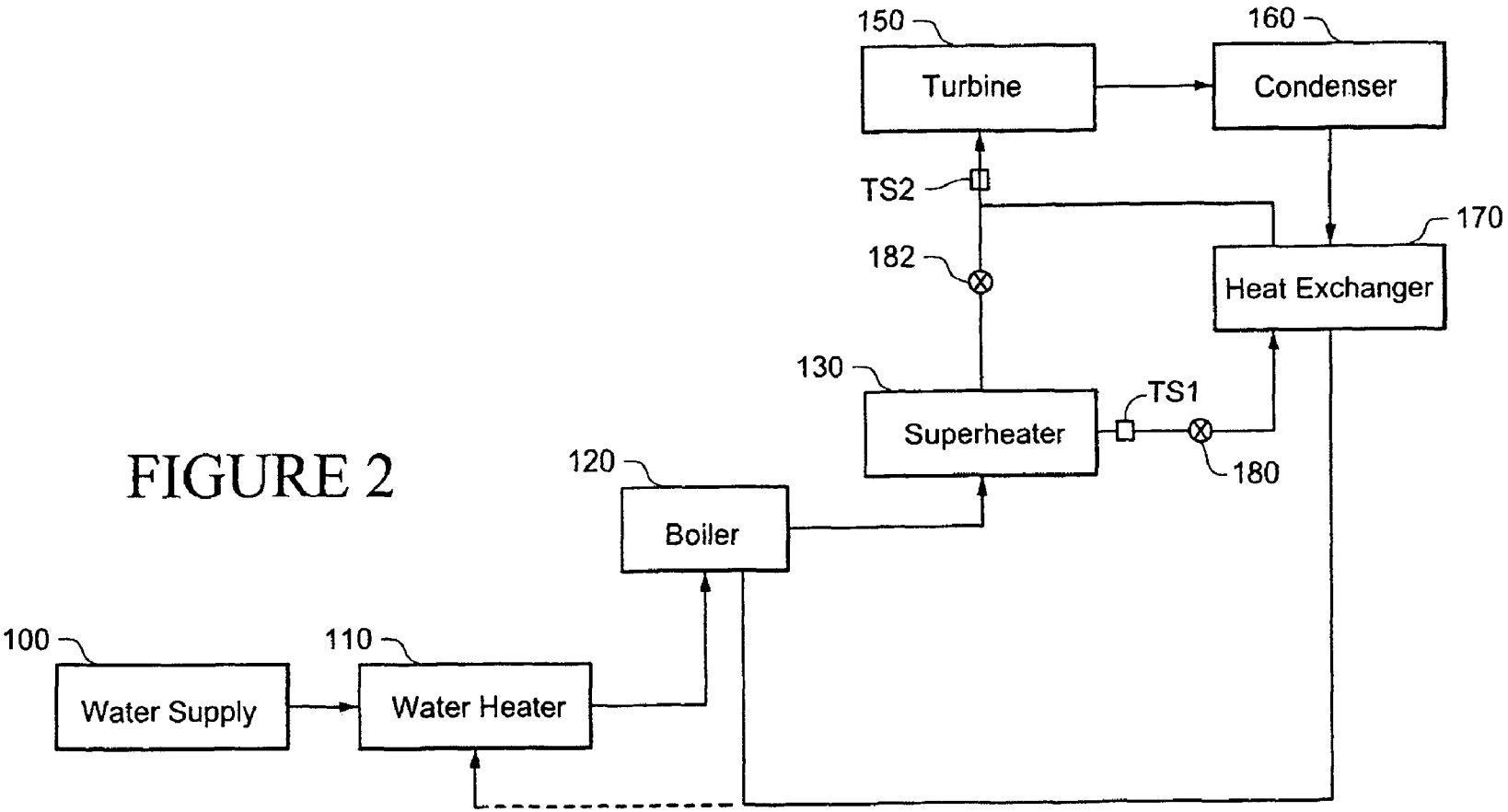
FIG. 2 is a diagram illustrating a first embodiment of a steam generation and turbine system using a heat exchanger as a desuperheater.

Ideally, one would like to capture the heat energy which must be removed from the superheated steam to reduce the temperature of the superheated steam to a temperature acceptable to the turbine. One way of accomplishing this is using a system as illustrated in FIG. 2. In this system, a heat exchanger is used to transfer the excess heat of the superheated steam to the condensed water being returned to the boiler.

As shown in FIG. 2, the system still includes the water supply 100, water heater 110, boiler 120, and superheater 130. However, rather than routing the superheated steam through an attemporator, in this system, all or a portion of the superheated steam is routed through a heat exchanger 170 on its way to the turbine 150. Water from the condenser 160 is also routed through the heat exchanger 170. As a result, heat from the superheated steam leaving the superheater 130 is transferred to the water passing from the condenser 160 back to the boiler 120. The superheated steam is then provided at a lower temperature to the turbine 150. As a result, the heat energy which must be removed from the superheated steam is transferred to the water being returned to the boiler 120, which reduces the amount of energy that must be consumed by the boiler to convert the condensed water back into steam.

As illustrated in FIG. 2, a control valve 180 is located on the path to the heat exchanger 170. A path is also provided directly from the superheater 130 to the turbine 150, and a control valve 182 is located along this path. If the steam produced by the superheater 130 is already at a temperature which is optimal for the turbine 150, then the control valve 180 can be fully closed and the control valve 182 can be fully opened so that all the superheated steam produced by the superheater 130 passes directly to the turbine 150. Alternatively, if the temperature of the superheated steam being produced by the superheater 130 is too high, a portion of the superheated steam can be routed through the heat exchanger 170 and then mixed back with another portion of the superheated steam to create a superheated steam mixture which is at an ideal temperature for the turbine 150. By selectively opening or closing the control valves 180, 182, selected amounts of the superheated steam can be routed through the heat exchanger so that the superheated steam mixture entering the turbine 150 is at a desired temperature.

In the embodiment shown in FIG. 2, a first temperature sensor TS1 is located on the path to the heat exchanger 170. This allows the system to determine the temperature of the superheated steam leaving the superheater. In alternate embodiments, the first temperature sensor TS1 could be located on the path leading directly to the turbine 150.

In addition, a second temperature sensor TS2 is located adjacent to the input to the turbine 150. This allows the system to determine the temperature of the mixture of the superheated steam that is entering the turbine 150.

Figure 3:
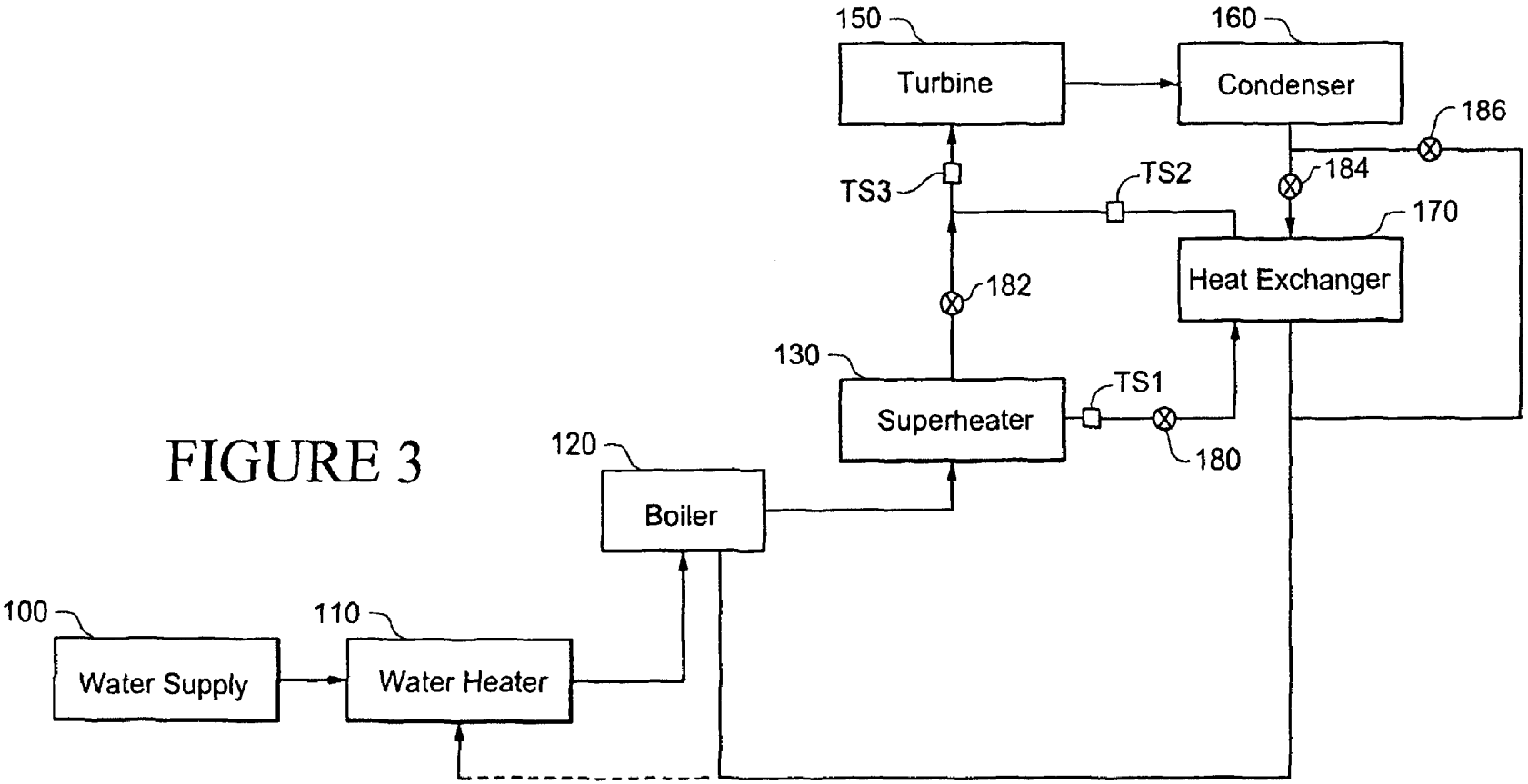
FIG. 3 is a diagram illustrating an alternate embodiment of a steam generation and turbine system which utilizes a heat exchanger as a desuperheater.

FIG. 3 illustrates an alternate embodiment of a system which includes a desuperheater in the form of a heat exchanger. The system illustrated in FIG. 3, is similar to the one illustrated in FIG. 2, in that all or a portion of the superheated steam leaving the superheater 130 can be provided directly to the turbine 150, or it can be routed through the heat exchanger 170.

In the system illustrated in FIG. 3, a first temperature sensor TS1 is provided at the output of the superheater. As noted above, in alternate embodiments, the first temperature sensor TS1 could be located on the path leading directly to the turbine 150. A second temperature sensor TS2 is provided at the exit of the heat exchanger 170. The second temperature sensor would provide an indication of the temperature of the steam after it has passed through the heat exchanger 130. Thus, comparing the temperatures sensed by the first and second temperature sensors will provide an indication of how much heat is being removed in the heat exchanger.

A third temperature sensor TS3 is provided at the input to the turbine 150. When portions of the superheated steam are being routed through two separate paths, one leading directly from the superheater 130, and the other passing through the heat exchanger 170, the third temperature sensor TS3 would provide an indication of the temperature of the mixture of the two portions of the steam. The various temperatures sensed by the first, second and third temperature sensors would be used to control the two control valves 180 and 182 to vary the amounts of the superheated steam passing through the two paths so that the temperature of the superheated steam provided to the turbine 150 is at the optimal temperature.

In addition, in the system illustrated in FIG. 3, the water leaving the condenser 160 could pass through two separate paths. All or a portion of the water leaving the condenser 160 could be routed through the heat exchanger 170. Alternatively, all or a portion of the water could be routed along a bypass route which bypasses the heat exchanger 170. A first water control valve 184 is located at the input to the heat exchanger 170, and a second water control valve 186 is located on the bypass route. The first water control valve 184 and the second water control valve 186 can be selectively opened and closed to route a desired amount of water through the heat exchanger.

For instance, if the temperature of the superheated steam leaving the superheater 130 is already at the optimal temperature, then all the superheated steam would be passed directly to the turbine 150. Because no superheated steam needs to be cooled in the heat exchanger 170, sending the water from the condenser 160 through the heat exchanger 170 may unnecessarily cool the water, or it may require additional pumping energy which would also represent a loss. If it is not necessary to cool any of the superheated steam in the heat exchanger 170, the water from the condenser 160 can simply be routed around the bypass route directly to the boiler 120 by fully closing the first water control valve 184 and fully opening the second water control valve 186.

Of course, the first and second water control valves could also be selectively opened to varying degrees to route a first portion of the water from the condenser 160 through the heat exchanger 170, and to route a second portion of the water through the bypass route. This could be done to control the amount or flow rate of the of water passing through the heat exchanger 170, to thereby control the amount of heat being transferred from the superheated steam to the water.

Figure 4:
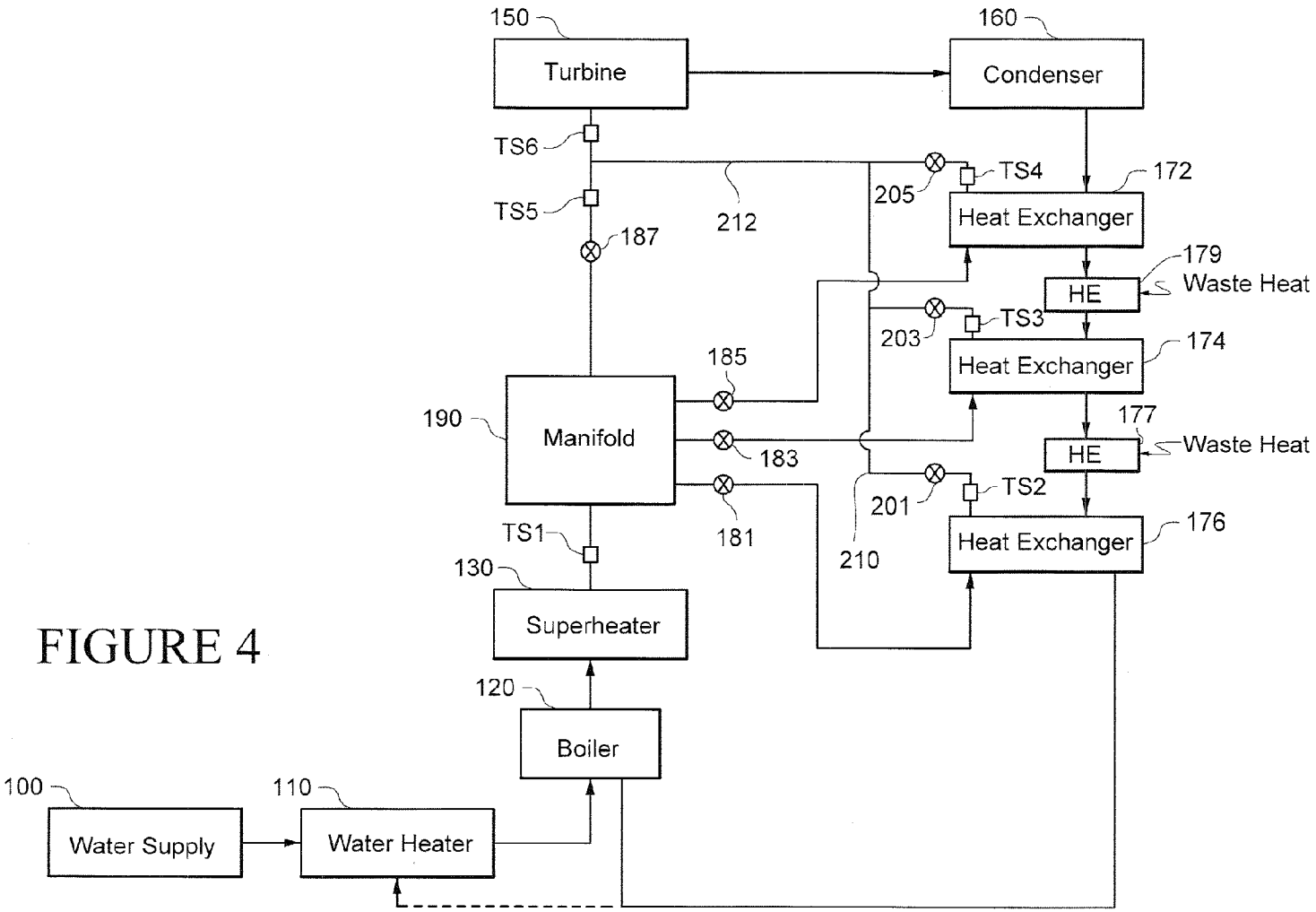
FIG. 4 is a diagram illustrating another alternate embodiment of a steam generation and turbine system which utilizes multiple heat exchanges as a desuperheater.

FIG. 4 illustrates yet another embodiment of the system which utilizes a desuperheater to cool the superheated steam leaving a superheater 130. In this embodiment, the superheated steam leaving the superheater 130 would be provided to a distribution manifold 190. The distribution manifold 190 would be capable of sending selected amounts of the superheated steam to a first heat exchanger 172, a second heat exchanger 174, a third heat exchanger 176, or the turbine itself 150. Steam control valves 181, 183, 185 and 187 would be used to control the amount of steam passing along the various different paths.

In addition, in the system illustrated in FIG. 4, water from the condenser 170 would first pass through the first heat exchanger 172. The water would then pass through a first waste heat exchanger 179 which would use waste heat to increase the temperature of the water. The waste heat would be received/taken from some other portion of the power plant. As a result, the temperature of the water entering the second heat exchanger 174 would be greater than a temperature of the water entering the first heat exchanger 172.

Likewise, a second waste heat exchanger 177 would be located between the second heat exchanger 174 and the third heat exchanger 176. This second waste heat exchanger 177 would also use waste heat to increase the temperature of the water. As a result, water entering the third heat exchanger 176 would have a temperature which is higher than the temperature of the water entering the first heat exchanger 172 or the second heat exchanger 174.

In the system as illustrated in FIG. 4, portions of the superheated steam exiting the superheater 130 could be passed through one or more of the first, second and third heat exchangers depending on what would make the most efficient use of the heat within the system. In some instances, it may be desirable to route all or a portion of the superheated steam through the first heat exchanger 172 where the greatest temperature difference will exist between the superheated steam and the water. In other instances, it may be more efficient to route all or a portion of the superheated steam through the third heat exchanger 176, where the temperature difference between the superheated steam and the water will not be as great.

The system illustrated in FIG. 4 also includes a first temperature sensor TS1 located at the exit of the superheater. Second, third and fourth temperature sensors TS2, TS3 and TS4 are located at the exits of the three heat exchangers. A fifth temperature sensor TS5 would be located at the exit of the manifold 190 on the path leading directly to the turbine 150. Also, a sixth temperature sensor TS6 could be located at the input to the turbine 150. The sixth temperature sensor TS6 could be used to determine the temperature of the steam after steam from the various paths has been mixed together.

The system in FIG. 4 also includes control valves 201, 203, 205 located on the exit sides of the first, second and third heat exchangers. These control valves are provided to ensure that each of the individual heat exchangers can be isolated from the other heat exchangers. These control valves are optional, and may not be provided in alternate embodiments. The pipes 210,212 leading from the control valves 201, 203,205 to the turbine 150 act as a collection manifold that receives and mixes the superheated steam after it has passed through the heat exchange to create a mixture of the superheated steam.

In alternate embodiments, some of these temperature sensors could be eliminated. In any event, the amounts of superheated steam passing through the first, second and third heat exchangers, and passing directly to the turbine, would be selectively controlled based on the sensed temperature to ensure that the superheated steam is provided to the turbine 150 at an optimal temperature.

Although not shown in FIG. 4, a system as illustrated in FIG. 4 could also include bypass routes for the condensed water passing from the condenser 160 back to the boiler 120. Such bypass routes, as illustrated in FIG. 3, could be provided around one or all of the heat exchangers.

In addition, although the embodiment illustrated in FIG. 4 includes three heat exchangers, in alternate embodiments, only two heat exchangers could be provided. Further, more than three heat exchangers could be provided.

Further, in the embodiment shown in FIG. 4, two waste heat exchangers 177, 179 are used to transfer heat from waste heat sources to the water being returned to the boiler. In alternate embodiments, none of these waste heat exchangers could be present, only one waste heat exchanger could be provided, or additional waste heat exchangers could be provided. Also, in alternate embodiments, to the extent any waste heat exchangers are provided, they could be located at different positions in the system.

In addition, although the heat exchangers illustrated in the above-described embodiments are used to heat water which is returned to the boiler 120, in alternate embodiments the heat removed from the superheated steam could be used for other advantageous purposes within the entire system. The important point is that the reduction in the temperature of the superheated steam is achieved by removing heat from the superheated steam and then using that heat for a useful purpose.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A system for generating superheated steam for a turbine, comprising:

a superheater that receives steam from a boiler and that generates superheated steam;

a first heat exchanger that is coupled to the superheater such that it can receive at least a portion of the superheated steam generated by the superheater and that is coupled to a water supply, wherein the first heat exchanger transfers heat from the superheated steam to the water such that a temperature of the superheated steam is lowered and a temperature of the water is raised;

a second heat exchanger that is coupled to the superheater such that it can receive at least a portion of the superheated steam generated by the superheater and that is coupled to the first heat exchanger such that it can receive water that has passed through the first heat exchanger, wherein the second heat exchanger transfers heat from the superheated steam to the water received from the first heat exchanger such that a temperature of the superheated steam is lowered and a temperature of the water is raised; and a collection manifold that receives and mixes superheated steam after it has passed through the first and second heat exchangers to create a mixture of the superheated steam, wherein the collection manifold provides the mixture of superheated steam to a turbine.

2. The system of claim 1, wherein the first heat exchanger receives a first portion of the superheated steam generated by the superheater and wherein the second heat exchanger receives a second portion of the superheated steam generated by the superheater.

3. The system of claim 1, wherein the collection manifold also receives superheated steam directly from the superheater and mixes the superheated steam received directly from the superheater with the superheated steam received from the first and second heat exchangers.

4. The system of claim 3, wherein the collection manifold provides the mixture of the superheated steam received from the first and second heat exchangers and the superheater to a turbine.

5. The system of claim 3, further comprising a distribution manifold that receives superheated steam from the superheater and that selectively distributes portions of the superheated steam to the first and second heat exchangers.

6. The system of claim 5, further comprising:

a first temperature sensor that senses a temperature of the superheated steam generated by the superheater; and a second temperature sensor that senses a temperature of the superheated steam after it has been collected and mixed in the collection manifold.

7. The system of claim 6, wherein the distribution manifold selectively controls the amounts of superheated steam routed through the first and second heat exchangers based on the temperatures sensed by the first and second temperature sensors such that a temperature of the superheated steam exiting the collection manifold is at or below a predetermined temperature.

8. A method of generating superheated steam for a turbine, comprising:

generating superheated steam in a superheater;

routing a first portion of the superheated steam through a first heat exchanger to transfer heat from the superheated steam to a stream of water, to thereby raise the temperature of the water and lower the temperature of the first portion of the superheated steam;

routing a second portion of the superheated stream generated by the superheater and water exiting the first heat exchanger through a second heat exchanger to transfer heat from the second portion of the superheated steam to water received from the first heat exchanger;

mixing the superheated steam exiting the first and second heat exchangers to create a first mixture of superheated steam; and providing the first mixture of superheated steam to the turbine.

9. The method of claim 8, further comprising mixing the first mixture of superheated steam with a portion of superheated steam taken directly from the superheater to create a second mixture of superheated steam that is at or below a predetermined temperature, wherein the providing step comprises providing the second mixture of superheated steam to the turbine.

10. The method of claim 9, further comprising controlling an amount of superheated steam passing through the first and second heat exchangers to thereby control the temperature of second mixture of superheated steam.

* * * * *

UNITED STATES PATENT AND TRADEMARK OFFICE

CERTIFICATE OF CORRECTION

PATENT NO. : 8,347,827 B2
APPLICATION NO. : 12/424570
DATED : January 8, 2013
INVENTOR(S) : Travaly et al.

It is certified that error appears in the above-identified patent and that said Letters Patent is hereby corrected as shown below:

In Claim 8, at column 7, line 21, delete "stream" and insert --steam--

Signed and Sealed this
Fifth Day of March, 2013

Teresa Stanek Rea
*Acting Director of the United States Patent and Trademark Office*